US005648192A

United States Patent [19]

Kuramae et al.

[11] Patent Number: 5,648,192

[45] Date of Patent: Jul. 15, 1997

[54] ELECTROPHOTOGRAPHIC TONER

[75] Inventors: Yoshihisa Kuramae; Kazushige Inoue; Takashi Nagai; Toru Takatsuna, all of Osaka, Japan

[73] Assignee: Mita Industrial Co., Ltd., Japan

[21] Appl. No.: 559,371

[22] Filed: Nov. 16, 1995

[30] Foreign Application Priority Data

Nov. 30, 1994 [JP] Japan ..... 6-297502

[51] Int. Cl.[6] ..... G03G 9/087

[52] U.S. Cl. ..... 430/110; 430/106

[58] Field of Search ..... 430/106, 109, 430/110

[56] References Cited

U.S. PATENT DOCUMENTS 5,166,026 11/1992 Fuller et al. ..... 430/106
5,482,807 1/1996 Aoki et al. ..... 430/110

FOREIGN PATENT DOCUMENTS 83301153 9/1983 European Pat. Off. .
60-67961 4/1985 Japan .
60-73547 4/1985 Japan .
60-217370 10/1985 Japan .

*Primary Examiner*—John Goodrow
*Attorney, Agent, or Firm*—Beveridge, DeGrandi, Weilacher & Young, L.L.P.

[57] ABSTRACT

There is disclosed a positive charging type electrophotographic toner comprising a fixing resin, and a colorant and an electric charge controlling material, which are contained in the fixing resin, the electric charge controlling material being an electric charge controlling resin comprising a polymer which is compatible with the fixing resin, a molecular-weight distribution of the polymer resembling a molecular-weight distribution of a weight-average molecular weight of not more than 20,000 in the molecular-weight distribution of the fixing resin, and a group corresponding to a quaternary ammonium salt being contained at the side chain of the polymer. This toner is superior in charging properties, fixing properties, offset resistance and strength, because a resin having a quaternary ammonium salt group is used as the electric charge controlling material.

6 Claims, 1 Drawing Sheet

ELECTROPHOTOGRAPHIC TONER

BACKGROUND OF THE INVENTION

The present invention relates to an electrophotographic toner, and more particularly, relates to an electrophotographic toner which is used for image forming apparatuses such as electrostatic copying machine and laser beam printers.

The electrophotographic toner is normally produced by dispersing a colorant, an electric charge controlling material, etc. in a suitable fixing resin, followed by pulverizing and screening.

As the above electric charge controlling material, various compounds such as dyes, etc. have been used according to the charging polarity of the toner. As the positively charging toner, the use of a quaternary ammonium salt, which contains no metal and is white, has recently been studied in view of consideration for environments, correspondence to a color toner, etc.

However, since the crystallizability of a normal low-molecular weight quaternary ammonium salt is high and the dispersion properties to the fixing resin are not sufficient, the charging properties are inferior. Therefore, the charged amount becomes lower than a predetermined value and it charged to a reverse polarity, thereby causing image failures, such as the so-called image fog wherein toner is adhered to blanks in an formed image, and toner scattering, etc. There is also a problem of the charging stability, that is, scattering of the image density arises when the image is formed repeatedly.

It can also be considered that the amount of the low-molecular weight quaternary ammonium salt to be added is increased in order to obtain a sufficient charged amount. However, since the quaternary ammonium salt does not have sufficient dispersion properties to the fixing resin as described above, the strength of the toner is decreased when a large amount of it is added. In addition, the toner is liable to be broken when it is repeatedly mixed with stirring in a developing apparatus of the image forming apparatus, thereby causing the problem that the powder of the fixing resin and quaternary ammonium salt generated from the broken toner contaminate the interior of the developing apparatus, or they adhere to a magnetic carrier constituting a two-component developer, together with the toner, to cause a so-called spent contamination.

Furthermore, there is also the problem that it is not easy to adjust or confirm the dispersion properties of the low-molecular weight quaternary ammonium salt to the fixing resin, thereby making it difficult to control the quality of the toner.

In Japanese Unexamined Patent Publication Nos. 60-067961, 60-073547 and 60-217370, there is disclosed that a resin (electric charge controlling resin) wherein a group corresponding to the quaternary ammonium salt (hereinafter referred to as a "quaternary ammonium salt group") is introduced at the side chain of a polymer which is compatible with a fixing resin is used as an electric charge controlling material.

Such an electric charge controlling material is compatible with the fixing resin uniformly on the whole and, therefore, it has the advantage that high charging properties can be imparted to the toner by adding a small amount of it in comparison with the quaternary ammonium salt.

However, the charging properties of the toner are insufficient when the quaternary ammonium salt is merely subjected to polymer-processing. Therefore, the same problem as that in case of using the low-molecular weight quaternary ammonium salt arises, or other characteristics of the toner, e.g. fixing properties, offset resistance, the strength of the toner, etc. are likely to be deteriorated.

SUMMARY OF THE INVENTION

It is a main object of the present invention to provide a positive charging type electrophotographic toner, which is superior in charging properties, fixing properties, offset resistance, strength, etc., by using a resin having a quaternary ammonium salt group at the side chain as an electric charge controlling material.

In order to accomplish the above object, the present inventors have studied intensively about the relation between physical properties of each component constituting the electrophotographic toner, particularly fixing resin and electric charge controlling resin, and characteristics of the electrophotographic toner. As a result, it has been found that the relation between the molecular-weight distribution of the fixing resin and that of the main chain of the polymer constituting the electric charge controlling resin has an important influence on the charging properties, fixing properties, offset resistance, strength, etc. of the electrophotographic toner.

The fixing resin of the toner is normally designed so that it has a so-called "bimodal molecular-weight distribution" having a maximum value of the molecular-weight distribution at a low-molecular weight region where the weight-average molecular weight is not more than 20,000 and a high-molecular weight region where the weight-average molecular weight exceeds 20,000, respectively, in order to satisfy good fixing properties at low temperature and high offset resistance, simultaneously. Regarding such a fixing resin having the bimodal molecular-weight distribution, the resin at the low-molecular weight region contributes to good fixing properties at low temperature and the resin at the high-molecular weight region contributes to the improvement of the offset resistance.

However, when the molecular weight of the electric charge controlling resin is lower than the molecular weight at the low-molecular weight region, the molecular-weight distribution of the whole resin contained in the toner extends toward the low-molecular weight side. Therefore, the low-temperature fixing properties are improved but the offset resistance is deteriorated.

In addition, the electric charge controlling resin has the quaternary ammonium salt group at the side chain. Therefore, the glass transition temperature is higher than that of the main chain polymer as the base and the resin is liable to become hard. Accordingly, when the molecular weight of the electric charge controlling resin is about the same as that of the resin at the high-molecular weight side among the molecular-weight distribution of the fixing resin of the toner or higher than that, it becomes difficult for the electric charge controlling resin to be compatible with the fixing resin. Therefore, not only the charging properties of the toner becomes insufficient similar to the case when using the low-molecular weight quaternary ammonium salt, but also the strength is lowered and the toner is liable to be broken. In addition, the electric charge controlling resin has a high glass transition temperature and is hard, as described above. Therefore, the fixing properties of the toner using this electric charge controlling resin are also deteriorated.

Thus, the present inventors have studied, furthermore. As a result, they have found a novel fact that, there can be provided a positive charging type electrophotographic toner, which is superior in various characteristics such as charging properties, fixing properties, offset resistance, strength, etc., by accomplishing an electrophotographic toner comprising a fixing resin, and at least a colorant and an electric charge controlling material, which are contained in the fixing resin, the electric charge controlling material being an electric charge controlling resin comprising a polymer which is compatible with the fixing resin, a molecular-weight distribution of the polymer resembling a molecular-weight distribution having a weight-average molecular weight of not more than 20,000 in the molecular-weight distribution of the fixing resin, and a quaternary ammonium salt group being introduced into the polymer.

That is, in the electrophotographic toner of the present invention, an electric charge controlling resin having a quaternary ammonium salt which is safe and capable of dealing with a color toner is used as an electric charge controlling material. Therefore, all problems arisen when using the low-molecular weight quaternary ammonium salt can be solved.

In addition, the above electric charge controlling resin has a molecular-weight distribution which resembles that of the resin having the weight-average molecular weight of not more than 20,000 in the molecular-weight distribution of the fixing resin. Therefore, it has no influence on the molecular-weight distribution of the fixing resin, and does not make the compatibility with the fixing resin insufficient.

DETAILED DESCRIPTION OF THE INVENTION

The electrophotographic toner of the present invention is composed according to the same manner as that of a conventional one except for using an electric charge controlling resin having a specific molecular-weight distribution and a quaternary ammonium salt group at the side chain as the electric charge controlling material, as described above. That is, the electrophotographic toner is formed by formulating the above electric charge controlling resin and a colorant in the fixing resin.

Figure 1:
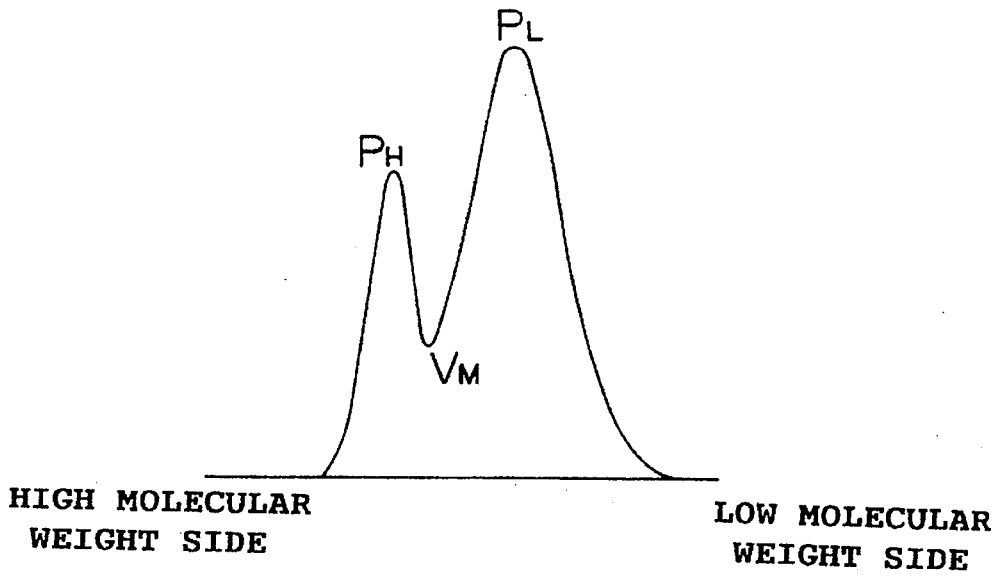
FIG. 1 is a gel permeation chromatogram illustrating one embodiment of a molecular-weight distribution of a fixing resin to be used in the present invention.

As the fixing resin, those having the so-called bimodal molecular-weight distribution are suitably used because good fixing properties at low temperature and high offset resistance can be satisfied simultaneously, as described above. For example, there can be suitably used those which have maximum values $P_L$ and $P_H$ of the molecular-weight distribution at the low-molecular weight region where the molecular weight is not more than 20,000 and the high-molecular weight region where the molecular weight exceeds 20,000, respectively, as shown in FIG. 1, and have a molecular-weight distribution having a minimum value $V_M$ of the molecular-weight distribution between both maximum values $P_L$ and $P_H$, as the fixing resin.

In order to make the molecular-weight distribution of the fixing resin to be a bimodal molecular-weight distribution as described above, for example, a component having a molecular-weight distribution corresponding to the above low-molecular weight region and a component having a molecular-weight distribution corresponding to the above high-molecular weight region may be blended. In addition, by utilizing the fact that a high-molecular weight polymer is easily formed according to suspension polymerization method or emulsion polymerization method in comparison with solution polymerization method, the polymerization is carried out using suspension polymerization method or emulsion polymerization method in combination with solution polymerization method in this order or reverse order, and the molecular weight is adjusted at each stage, thereby making the molecular-weight distribution of the fixing resin to be the bimodal molecular-weight distribution, as described above.

Examples of the fixing resin include styrene resins (styrene, or homopolymers or copolymers containing a styrene-substituted substance) such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylate copolymer (e.g. styrene-methyl methacrylate copolymer, styrene-ethyl methacrylate copolymer, styrene-butyl methacrylate copolymer, styrene-phenyl methacrylate copolymer, etc.), styrene-α-methyl chloroacrylate copolymer, styrene-acrylonitrile-acrylate copolymer, etc.; polyvinyl chloride, low-molecular weight polyethylene, low-molecular weight polypropylene, ethylene-ethyl acrylate copolymer, polyvinyl butyral, ethylene-vinyl acetate copolymer, rosin-modified maleic acid resin, phenol resin, epoxy resin, polyester resin, ionomer resin, polyurethane resin, silicone resin, ketone resin, xylene resin, polyamide resin, etc. These can be used alone or in combination thereof.

In the present invention, styrene-acrylic acid type resins such as styrene-acrylate copolymer, styrene-methacrylate copolymer, which are normally used as a fixing resin of the electrophotographic toner, are particularly preferred.

As the colorant to be formulated in the above fixing resin, there can be used various dyes, pigments, etc., which have hitherto been known. In case of black toner, a carbon black is mainly used.

As the carbon black, for example, there can be used various carbon blacks which have hitherto been known, such as channel black, roller black, disc black, gas furnace black, oil furnace black, thermal black, acetylene black, etc.

The amount of the carbon black to be formulated is not specifically limited in the present invention. The carbon black has a conductivity itself and, therefore, it also serve as control means of electric characteristics, which take part in charging of the electrophotograplic toner. Accordingly, the preferred range of the amount may be set according to the objective performances of the toner. The amount of the carbon black to be formulated is not specifically limited, but is about 1 to 9 parts by weight, based on 100 parts by weight of the fixing resin, in view of the charging properties of the electrophotographic toner.

As the electric charge controlling material, there can be used an electric charge controlling resin wherein a quaternary ammonium salt group has been introduced at the side chain, as described above. Regarding the above electric charge controlling resin, the molecular-weight distribution of the main chain must resembles that of the component having a molecular weight of not more than 20,000 in the molecular-weight distribution of the fixing resin. The sentence "the molecular-weight distribution resembles" used herein means that their molecular-weight distribution curves due to gel permeation chromatogram are almost the same.

Figure 2:
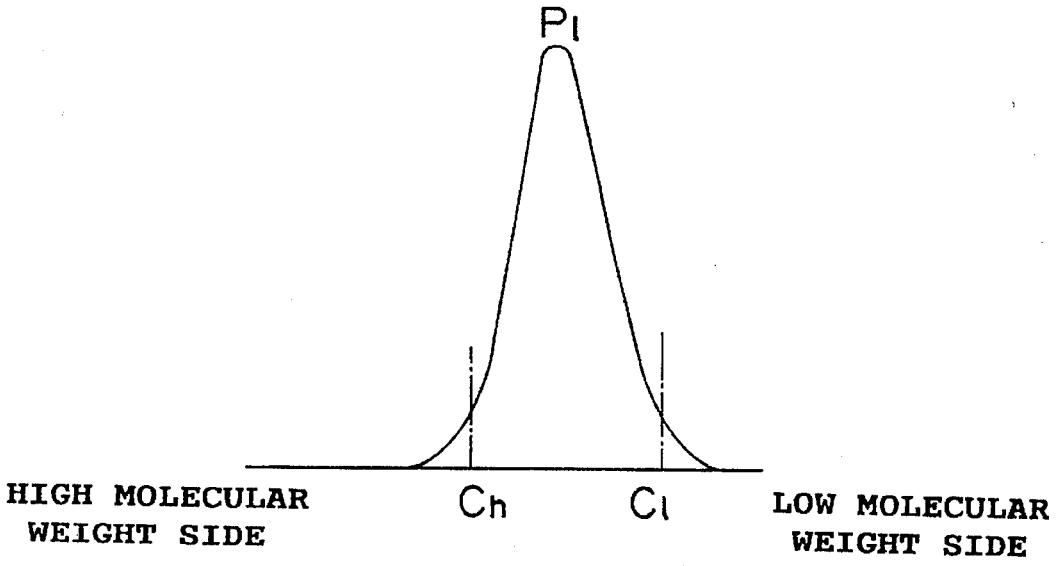
FIG. 2 is a gel permeation chromatogram illustrating one embodiment of a molecular-weight distribution of an electric charge controlling resin to be added to the fixing resin.

For example, when using those having a bimodal molecular-weight distribution shown in FIG. 1 as the fixing resin, the main chain of the electric charge controlling resin may have a molecular-weight distribution of which shape is almost the same as that of the molecular-weight distribution containing a maximum value $P_L$ at the low-molecular weight side of the above fixing resin shown in FIG. 2.

The molecular-weight distribution of the main chain of the electric charge controlling resin may not have the same shape as that of the molecular-weight distribution of the component having a molecular-weight of not more than 20,000 of the fixing resin, completely, if it's main part resembles thereto. For example, in the molecular-weight distribution having the above shape, the molecular weight $P_1$ of the maximum value and the degree of dispersion of the molecular-weight distribution before and behind it are important. It is necessary that these main parts have the same shape, but both foot parts of the peak may be different slightly. More concretely, the component having a molecular weight higher than a specific molecular weight shown by the symbol $C_h$ in FIG. 2 (part on the left side of $C_h$) and the component having a molecular weight lower than a specific molecular weight shown by the symbol $C_l$ (part on the right side of $C_l$) can be cut, respectively.

A main purpose of cutting the component having a molecular weight higher than a specific molecular weight $C_h$ is to prevent deterioration of the compatibility of the electric charge controlling resin with the fixing resin due to the high-molecular weight component. When the molecular weight of the foot part at the high-molecular weight side exceeds 20,000, the high-molecular weight component may be cut so that the molecular weight $C_h$ may become smaller than or equal to 20,000.

On the other hand, a main purpose of cutting the component having a molecular weight lower than a specific molecular weight $C_1$ is to prevent deterioration of the offset resistance due to the low-molecular weight component.

In addition, the lower limit of the molecular weight of the main chain of the electric charge controlling resin is not specifically limited, but is preferably not less than 2000, taking prevention of deterioration of the offset resistance due to the low-molecular weight component into consideration. Accordingly, the weight-average molecular weight of the main chain of the electric charge controlling material is preferably within a range of 2,000 to 20,000, more preferably within a range of 3,000 to 10,000.

As the main chain of the electric charge controlling resin, various polymers can be used. Among them, a main chain having a good compatibility with a polymer to be used as the fixing resin is used, preferably, because the compatibility with the fixing resin becomes important in view of the charging properties and the like of the toner. Among them, the same polymer to be used as the fixing resin is used more preferably.

For example, when using the above styrene-acrylic acid type resin as the fixing resin, it is preferred to use the same styrene-acrylic acid type resin as the main chain of the electric charge controlling resin. It is considered that when the main chain is the styrene-acrylic acid type resin, the quaternary ammonium salt group is substituted, for example, on the ester moiety of the resin.

The amount of the electric charge controlling resin to be formulated is not specifically limited in the present invention. It is preferred to adjust the amount of the quaternary ammonium salt group to be contained in the electric charge controlling resin, not the amount of the electric charge controlling resin, in order to obtain a proper charged amount of the toner.

As the method for adjusting the amount of the quaternary ammonium salt group, for example, the following two methods are suitably used. These methods can be used alone or in combination thereof.

① The amount of the electric charge controlling resin to be formulated in the fixing resin is adjusted.

② The electric charge controlling resin wherein the amount of the quaternary ammonium salt group to be substituted on the main chain has been adjusted is used.

It is preferred that the amount of the quaternary ammonium salt group (Q.A.) contained in 1 g of the toner, which is adjusted according to the above method, is within a range of $1.5\times10^{-3}$ to $1.5\times10^{-2}$ g. This amount can be calculated by the following equation.

$$Q.A. = \frac{\text{Amount of } C.C.R}{\text{Amount of toner}} \times \frac{W}{100}$$

$$W = \frac{WC}{WP1 + WP2 + WC}$$

C.C.R: the electric charge controlling resin

W: proportion (% by weight) of the quaternary ammonium salt group in C.C.R.

WP1: weight of the first monomer (e.g. styrene) in C.C.R.

WP2: weight of the second monomer (e.g. ester of acrylic acid)

WC: weight of the quarternary ammonium salt group in C.C.R.

When the amount of the quaternary ammonium salt group is less than the above range, the charging properties of the toner are likely to be deteriorated. On the contrary, when the amount of the quaternary ammonium salt group exceeds the above range, the low-temperature fixing properties are likely to be deteriorated. Particularly, if the amount of the quaternary ammonium salt group exceeds the above range when the amount of the quaternary ammonium salt group is adjusted according to the above method ②, the glass transition temperature of the electric charge controlling resin becomes high and the resin becomes hard, which results in deterioration of the compatibility with the fixing resin. Therefore, the charging properties of the toner or strength is likely to be lowered.

The quaternary ammonium salt group is represented, for example, by the general formula:

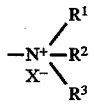

wherein $R^1$, $R^2$ and $R^3$ are the same or different and indicate a hydrogen atom, or an alkyl or phenyl group having 1 to 6 carbon atoms; and $X^-$ is an anion such as halogen anion, carboxylato anion, etc.

Various additives such as release agents (offset inhibitors), etc. may be added to the electrophotographic toner, in addition to the above colorants and electric charge controlling materials.

Examples of the release agent (offset inhibitor) include aliphatic hydrocarbons, aliphatic metal salts, higher fatty acids, fatty acid esters or a partially saponified material thereof, silicone oil, various wax. Among them, aliphatic hydrocarbons having an weight-average molecular weight of about 1,000 to 10,000 are preferred. For example, low-molecular weight polypropylene, low-molecular weight polyethylene, paraffin wax, low-molecular weight olefin polymer of an olefin unit having four or more carbon atoms, etc. may be suitably used alone or in combination thereof.

The release agent is formulated in the amount of 0.1 to 10 parts by weight, preferably 0.5 to 8 parts by weight, based on 100 parts by weight of the fixing resin.

By adding a magnetic substance powder, a magnetic toner as an one-component developer can be obtained.

The magnetic substance is a substance which is strongly magnetized by a magnetic field in the direction thereof. It is preferred that the magnetic substance is a fine particle having a particle size of not more than 1 μm, particularly about 0.01 to 1 μm, which is chemically stable. Examples of the typical magnetic substance include iron oxides such as magnetite, hematite, ferrite, etc.; metals such as iron, cobalt, nickel, etc.; alloys of these metals with aluminum, cobalt, copper, lead, magnesium, tin, zinc, antimony, beryllium, bismuth, cadmium, calcium, manganese, selenium, titanium, tungsten and vanadium; or a mixture thereof.

The amount of the magnetic substance powder to be formulated is preferably 20 to 300 parts by weight, more preferably 50 to 150 parts by weight, based on 100 parts by weight of the fixing resin.

In addition, various additives such as stabilizers, etc. may be formulated in the appropriate amount.

The electrophotographic toner is produced by melting a mixture, which is obtained by previously mixing the above respective components uniformly with a dry blender, Henschel mixer, ball mill, etc., uniformly with a kneading apparatus such as Banbury mixer, roll, single-screw or twin-screw extruder kneader, pulverizing the kneaded product, followed by classifying optionally. In addition, it can also be produced by a suspension polymerization method or other polymerization method.

The particle size of the electrophotographic toner is 3 to 30 μm, preferably 4 to 20 μm. In case of small-particle size toner for the purpose of attaining high image quality of the formed image, it is preferably about 4 to 10 μm.

In addition, surface treating agents can also be added to the surface of the electrophotographic toner for the purpose of improving the fluidity.

As the surface treating agent, there can be used various surface treating agents which have hitherto been known, such as inorganic fine particles, fluororesin particles, etc. Particularly, there can be suitably used silica surface treating agents containing hydrophobic or hydrophilic silica fine particles, such as ultrafine particulate silica anhydride, colloidal silica, etc.

The amount of the surface treating agent to be added is not specifically limited, and it may be the same as a conventional amount. For example, it is preferred to add the surface treating agent in the amount of about 0.1 to 3.0 parts by weight, based on 100 parts by weight of the toner particle. Sometimes, the amount of the surface treating agent to be added may deviate from this range.

The electrophotographic toner of the present invention can be applied for various toners which have hitherto been known, such as non-magnetic toner which is used alone as a non-magnetic one-component developer or which constitutes a two-component developer together with a magnetic carrier, magnetic toner which is used alone as a magnetic one-component developer, or a photosensitive toner having a photosensitivity itself.

When using the toner for the magnetic two-component developer, the concentration of the toner may be the same as that of a conventional amount, i.e. about 2 to 15% by weight. In case of magnetic toner, a magnetic pigment may be formulated in the fixing resin. Furthermore, in case of photosensitive toner, a photoconductive pigment, and a cyanine dye as a sensitizing component may be formulated in the fixing resin.

As described above, the electrophotographic toner of the present invention is superior in charging properties, fixing properties, offset resistance, strength, etc., because an electric charge controlling resin wherein a quaternary ammonium salt is transformed to a polymer by using a main chain having a molecular-weight distribution which resembles that of the component of the fixing resin having a molecular weight of not more than 20,000.

EXAMPLES

The following Examples and Comparative Examples further illustrate the present invention.

Example 1

As the fixing resin, a styrene-acrylic acid type resin having the following molecular-weight distribution was used. In addition, as the electric charge controlling material, an electric charge controlling resin (glass transition temperature: 70° C.) comprising a styrene-acrylic acid type resin having the following molecular-weight distribution as the main chain, wherein the content of a quaternary ammonium salt group is 0.15% by weight, was used. The molecular-weight distribution of both components was measured by a gel permeation chromatogram.

<Fixing Resin>

Molecular weight of maximum value $P_H$: 120,000

Dispersion of peak including maximum value $P_H$ ($M_W/M_N$): 5.6

Molecular weight of maximum value $P_L$: 7,200

Dispersion of peak including maximum value $P_L$ ($M_W/M_N$): 1.7

Molecular weight of maximum value $P_M$: 28,000

<Main Chain of Electric Charge Controlling Resin>

Molecular weight of maximum value $P_L$: 6,600

Dispersion of peak including maximum value $P_L$ ($M_W/M_N$): 2.0

100 Parts by weight of the above fixing resin and 5 parts by weight of an electric charge controlling resin were mixed with 7 parts by weight of a carbon black and 3 parts by weight of a polypropylene wax as a release agent. Then, the mixture was molten and kneaded, pulverized and classified to produce a positive charging type electrophotographic toner having an average particle size of 9 μm, wherein a content of a quaternary ammonium salt group is $7\times10^{-3}$ g per 1 g of the toner.

Comparative Example 1

According to the same manner as that described in Example 1 except for using 5 parts by weight of an electric charge controlling resin (glass transition temperature: 59° C.) comprising a styrene-acrylic resin having the following molecular-weight distribution as the main chain, wherein the content of a quaternary ammonium salt group is 0.15, as the electric charge controlling material, a positive charging type electrophotographic toner having the average particle size of 9 μm, wherein the content of a quaternary ammonium salt group is $7\times10^{-3}$ g per 1 g of the toner was produced.

<Main Chain of Electric Charge Controlling Resin>

Molecular weight of maximum value $P_L$: 3,000

Dispersion of peak including maximum value $P_L$ ($M_W/M_N$): 2.0

Comparative Example 2

According to the same manner as that described in Example 1 except for using 5 parts by weight of an electric charge controlling resin (glass transition temperature: 80° C.) comprising a styfane-acrylic resin having the following molecular-weight distribution as the main chain, wherein the content of a quaternary ammonium salt group is 0.15, as the electric charge controlling material, a positive charging type electrophotographic toner having the average particle size of 9 μm, wherein the content of a quaternary ammonium salt group is $7\times10^{-3}$ g per 1 g of the toner was produced.

<Main Chain of Electric Charge Controlling Resin>

Molecular weight of maximum value $P_L$: 18,000

Dispersion of peak including maximum value $P_L$ ($M_W/M_N$): 2.2

The electrophotographic toners of the above Examples and Comparative Examples were subjected to the following tests, and characteristics thereof were evaluated, respectively.

Charging Test

The charged amount (μC/g) of the respective electrophotographic toners obtained in the Example and Comparative Examples was measured using blow-off method, and the results were evaluated according to the following criteria.

Charging properties are excellent (◎) when the charged amount is not less than 30 μC/g.

Charging properties are good (○) when the charged amount is not less than 20 μC/g and less than 30 μC/g.

Charging properties are enough to put to practical use (Δ) when the charged amount is not less than 15 μC/g and less than 20 μC/g.

Charging properties are inferior (X) when the charged amount is less than 15 μC/g.

Fluidity Test

The electrophotographic toners of the Examples and Comparative Examples were treated with a hydrophobic silica in the amount of 0.3 parts by weight, based on 100 parts by weight of the toner, and the bulk density thereof was measured, respectively, according to the measuring method described in JIS K 5901. The results were evaluated according to the following criteria.

The fluidity is excellent (◎) when the bulk density exceeds 0.31 g/cc.

The fluidity is good (○) when the bulk density is 0.29 to 0.31 g/cc.

The fluidity is enough to put to practical use (Δ) when the bulk density is less than 0.27 g/cc and less than 0.29 g/cc.

Fixing Properties Test

The electrophotographic toners of the Example and Comparative Examples were treated with a hydrophobic silica in the amount of 3 parts by weight, based on 100 parts by weight of the toner, and then mixed with a ferrite carrier having an average particle size of 80 μm to prepare a two-component developer having a toner concentration of 4.0%. The resulting developer was used for a plain paper facsimile apparatus (Model AF-1000, manufactured by Mita Industrial Co., Ltd.) wherein the temperature of a heat fixing roller is set at 150° C. to copy a black solid manuscript.

Then, the image density of the copied image fixed on the paper surface by the above heat fixing roller was measured using a reflection densitometer (Model TC-6D, manufactured by Tokyo Denshoku Co., Ltd.) and the surface was forced to rub five times with a weight (20 g/cm$^2$) obtained by coating the bottom of a column (26 mm in height×50 mm in diameter) made of a mild steel with a cotton cloth. Then, the image density after rubbing was measured again using the above reflection densitometer to determine the fixing rate (%) according to the following equation:

Fixing rate (%)=[(Image density after rubbing)/(Image density before rubbing)]×100

The results were evaluated according to the following criteria.

The fixing rate is good (○) when it is not less than 95%.

The fixing rate is inferior (X) when it is less than 95%.

Offset Resistance Test

It was visually observed whether an offset arose or not when the above fixing test was carried out.

The offset resistance was evaluated according to the following criteria.

No offset arose (○).

Offset arose (X).

The above results are shown in Table 1, together with the amount of the quaternary ammonium salt group (in 1 g of the toner) of the toners of the Example and Comparative Examples, respectively.

TABLE 1

| | Ex. 1 | Comp.Ex.1 | Comp.Ex.2 |
|---|---|---|---|
| Quaternary ammonium salt group(g/1 g toner) | $7\times10^{-3}$ | $7\times10^{-3}$ | $7\times10^{-3}$ |
| Charge amount(μC/g) | 30 | 30 | 26 |
| Charging properties | ◎ | ◎ | ○ |
| Fluidity | ○ | ○ | ○ |
| Fixing properties | ○ | ○ | x |
| Offset resistance | ○ | x | ○ |

Examples 2 to 5

According to the same manner as that described in Example 1 except for using 5 parts by weight of an electric charge controlling resin comprising a styrene-acrylic resin having the same molecular-weight distribution as that of the electric charge controlling resin used in Example 1 as the main chain, wherein the content of a quaternary ammonium salt group is different, as the electric charge controlling material, a positive charging type electrophotographic toner having an average particle size of 9 μm was produced, respectively. The content of the quaternary ammonium salt group in the electric charge controlling resin used in the respective Examples and the glass transition temperature (°C.) of the electric charge controlling resin are as follows.

<Electric Charge Controlling Resin Used in Example 2>

Content of quaternary ammonium salt group: 0.05

Glass transition temperature: 70° C.

<Electric Charge Controlling Resin Used in Example 3>

Content of quaternary ammonium salt group: 0.15

Glass transition temperature: 71° C.

<Electric charge controlling resin used in Example 4>

Content of quaternary ammonium salt group: 0.30

Glass transition temperature: 74° C.

<Electric charge controlling resin used in Example 5>

Content of quaternary ammonium salt group: 0.40

Glass transition temperature: 74° C.

The toners obtained in the above Examples were subjected to the above tests, and characteristics thereof were evaluated, respectively. Among the above tests, the fixing properties test and offset resistance test were carried out by changing the temperature of the heat fixing roller to 140° C.

The above results are shown in Table 2, together with the content of the quaternary ammonium salt group (in 1 g of the toner) of the toners of the Examples, respectively.

TABLE 2

| | Ex. 2 | Ex. 3 | Ex. 4 | Ex. 5 |
|---|---|---|---|---|
| Quaternary ammonium salt group(g/1 g toner) | $2\times10^{-3}$ | $4.5\times10^{-3}$ | $1.3\times10^{-2}$ | $1.8\times10^{-2}$ |
| Charge amount(μC/g) | 20 | 27 | 16 | 16 |
| Charging properties | o | o | Δ | Δ |
| Fluidity | o | o | o | Δ |
| Fixing properties | o | o | o | o |
| Offset resistance | o | o | o | o |

Examples 6 to 9

According to the same manner as that described in Example 1 except for changing the amount of the electric charge controlling resin to 1 part by weight (Example 6), 3 parts by weight (Example 7), 10 parts by weight (Example 7) and 15 parts by weight (Example 9), a positive charging type electrophotographic toner having an average particle size of 9 μm was produced, respectively.

The above results are shown in Table 3, together with the content of the quaternary ammonium salt group (in 1 g of the toner) of the toners of the Examples, respectively.

TABLE 3

| | Ex. 6 | Ex. 7 | Ex. 8 | Ex. 9 |
|---|---|---|---|---|
| Quaternary ammonium salt group(g/1 g toner) | $1.3\times10^{-3}$ | $4\times10^{-3}$ | $1.3\times10^{-2}$ | $1.8\times10^{-2}$ |
| Charge amount(μC/g) | 9 | 22 | 26 | 16 |
| Charging properties | x | o | o | Δ |
| Fluidity | o | o | o | Δ |
| Fixing properties | o | o | o | o |
| Offset resistance | o | o | o | o |

What is claimed is:

1. An electrophotographic toner comprising a fixing resin, and at least a colorant and an electric charge controlling material, which are contained in this fixing resin, the fixing resin having a bimodal molecular-weight distribution having maximum values at a low molecular weight region where a weight average molecular weight is not more than 20000 and a high molecular weight region where a weight average molecular weight exceeds 20000, respectively; and the electric charge controlling material being an electric charge controlling resin comprising a polymer which is compatible with the fixing resin, a molecular-weight distribution of the polymer resembling the low molecular weight distribution of a weight-average molecular weight of not more than 20000 in the molecular-weight distribution of the fixing resin, and a group corresponding to a quaternary ammonium salt being introduced into the polymer.

2. The electrophotographic toner according to claim 1, wherein the group corresponding to the quaternary ammonium salt contained in the electric charge controlling resin is contained in the amount within a range of $1.5\times10^{-3}$ to $1.5\times10^{-2}$ g per 1 g of the toner.

3. The electrophotographic toner according to claim 1, wherein the weight-average molecular weight of the main chain of the electric charge controlling resin is within a range of 2,000 to 20,000.

4. The electrophotographic toner according to claim 1, wherein a magnetic powder is further contained as a component.

5. The electrophotographic toner according to claim 1, wherein a main chain of the electric charge controlling resin is compatible with the polymer to be used as the fixing resin.

6. The electrophotographic toner according to claim 1, wherein both a main chain and a fixing resin of the electric charge controlling resin are styrene-acrylic acid resins.

* * * * *